US010172200B2

(12) United States Patent
You et al.

(10) Patent No.: US 10,172,200 B2
(45) Date of Patent: Jan. 1, 2019

(54) SYSTEM FOR REGULATING THE MINIMUM OUTPUT CURRENT OF AN LED DIMMING POWER SUPPLY

(71) Applicants: Self Electronics Co., Ltd., Ningbo, Zhejiang (CN); Wanjiong Lin, Ningbo, Zhejiang (CN); Self electronics USA Corporation, Norcross, GA (US)

(72) Inventors: Xiaobo You, Zhejiang (CN); Xuejun Zou, Zhejiang (CN)

(73) Assignee: Self Electronics Co., Ltd., Ningbo (CN)

( * ) Notice: Subject to any disclaimer, the term of this patent is extended or adjusted under 35 U.S.C. 154(b) by 0 days.

(21) Appl. No.: 15/954,348

(22) Filed: Apr. 16, 2018

(65) Prior Publication Data

US 2018/0310372 A1 Oct. 25, 2018

(30) Foreign Application Priority Data

Apr. 19, 2017 (CN) ..... 2017 1 0256036

(51) Int. Cl.
*H05B 33/08* (2006.01)

(52) U.S. Cl.
CPC ..... *H05B 33/0815* (2013.01); *H05B 33/0845* (2013.01); *H05B 33/0848* (2013.01)

(58) Field of Classification Search
None
See application file for complete search history.

(56) References Cited

U.S. PATENT DOCUMENTS

| | | | | |
|---|---|---|---|---|
| 9,621,031 | B1 * | 4/2017 | Jain | H02M 3/04 |
| 9,854,639 | B1 * | 12/2017 | Wang | H05B 33/0887 |
| 9,924,575 | B2 * | 3/2018 | Ma | H05B 33/0851 |
| 2012/0098454 | A1 * | 4/2012 | Grotkowski | H05B 33/0815 315/246 |

* cited by examiner

*Primary Examiner* — Jany Richardson
(74) *Attorney, Agent, or Firm* — Wang Law Firm, Inc.

(57) ABSTRACT

A system for regulating the minimum output current of an LED dimming power supply, comprising: an initial value setting module, a data detection module, a data processing module, an output adjustment module, a DC/DC current output module electrically connected with the output adjustment module, a regulated load connected in series at the output of the DC/DC current output module, and an output regulation module. The present invention is capable of utilizing those modules mentioned above to make the regulated load modularization and standardization. It means that the resistance of the regulated load is designed to a standard value, and the regulated load is set in a standard module, when the batches of LED dimming power supply need to regulate the minimum output current. The output of the LED dimming power supply are electrically connected to the standard module provided with the regulated load to complete the setting of the minimum output current of the LED dimming power supply, so as to avoid human error caused by manual calibration.

9 Claims, 2 Drawing Sheets

SYSTEM FOR REGULATING THE MINIMUM OUTPUT CURRENT OF AN LED DIMMING POWER SUPPLY

CROSS-REFERENCE TO A RELATED APPLICATION

This application claims priority to a Chinese Patent Application No. CN 201710256036.X, filed on Apr. 19, 2017.

FIELD OF THE TECHNOLOGY

The present invention relates to the power equipment, with particular emphasis on a system for regulating the minimum output current of an LED dimming power supply.

BACKGROUND

Traditional lamps usually use halogen lamps as the electric light source. Halogen lamp has a highly power consumption with high temperature, and is not conducive to save energy. With the development of LED technology, people have found that LED is one of the best lighting sources at present, which has the advantages of high luminance and long service life. LED has been widely used in lighting as a light source. With the improvement of people's living standards, more and more residential buildings and commercial buildings begin to use some lamps for lighting. In particular, a lamp using LED as a light source is needed to save energy and increase the life of the lamp.

With the demand of the market and the requirements of the energy level, LED driver which is dimmable and high PF, high efficient came into being, dimmable LED drivers adjust the voltage PWM duty cycle or current amplitude in the market. PWM duty cycle adjustment method woks accompany a PWM frequency stroboscopic phenomenon, by its own technical limitations. The current amplitude adjustment can avoid stroboscopic phenomenon, while the two technologies are affected by the dispersion of different components. There is a problem that the brightness of the LED lamp is inconsistent when adjusted to a certain brightness value, especially when the lighting is adjusted to be most sensitive minimum brightness for the eyes. Therefore, the traditional solution is to manually intervene, to manually calibrate each LED dimming power supply, this method is time-consuming, labor-intensive, and sometimes brings about human error, and is not conducive to large-scale production calibration.

SUMMARY OF THE INVENTION

Therefore, it is necessary to provide a system for regulating the minimum output current of an LED dimming power supply.

A system for regulating the minimum output current of an LED dimming power supply, comprising: an initial value setting module being configured to preset a threshold value of a minimum output rated current of the LED dimming power supply and tune the control signal output by the output adjustment module that controls the output value of the DC/DC current output module to the minimum, a data detection module being configured to detect a load current flowing through the regulated load, a data processing module being configured to compare the load current with the threshold value and output a comparison result, an output adjustment module being configured to adjust the output control signal according to the output result of the data processing module, while the load current is less than the threshold value, in order to adjust the output voltage of the DC/DC current output module, and make sure that the current value on the regulated load is equal to the threshold value, a DC/DC current output module being configured to convert an input DC constant voltage into a DC constant current, electrically connected with the output adjustment module, a regulated load connected in series at the output of the DC/DC current output module, and an output regulation module being regulate the output value of the control signal of the output adjustment module when the load current is equal to the threshold value by adjusting the control signal of the output adjustment module.

Further, the output current value of the DC/DC current output module is greater than or equal to the threshold value.

Further, the regulated load is a resistor.

Further, the resistance of the resistor is greater than 200 ohms.

Further, the initial value setting module, the data detection module, and the data processing module are integrated in a microcontroller, and the microcontroller performs its functions.

Further, the output signal of the output adjustment module is a PWM signal.

Further, the output adjustment module is integrated in a microcontroller, and the microcontroller performs its functions.

Further, the LED dimming power supply comprises the initial value setting module, the data detection module, the data processing module, the output adjustment module, and the DC/DC current output module electrically connected with the output adjustment module.

Further, when the load current is greater than the threshold value, the LED dimming power supply is a non-qualified product.

Compared with the prior art, the system for regulating the minimum output current of the LED dimming power supply provided by the present invention is capable of utilizing the initial value setting module, the data detection module, the data processing module and the output regulation module to make the regulated load modularization and standardization. It means that the resistance of the regulated load is designed to a standard value, and the regulated load is set in a standard module, when the batches of LED dimming power supply need to regulate the minimum output current. The output of the LED dimming power supply are electrically connected to the standard module provided with the regulated load to complete the setting of the minimum output current of the LED dimming power supply, so as to avoid human error caused by manual calibration and be particularly suitable for the mass production calibration in the factory.

DETAILED DESCRIPTION OF THE DRAWINGS

The drawings described herein are intended to promote a further understanding of the present invention, as follows.

DESCRIPTION OF THE PREFERRED EMBODIMENTS

The present application is illustrated by way of the following detailed description based on of the accompanying drawings. It should be noted that illustration to the embodiment in this application is not intended to limit the invention.

Figure 1:
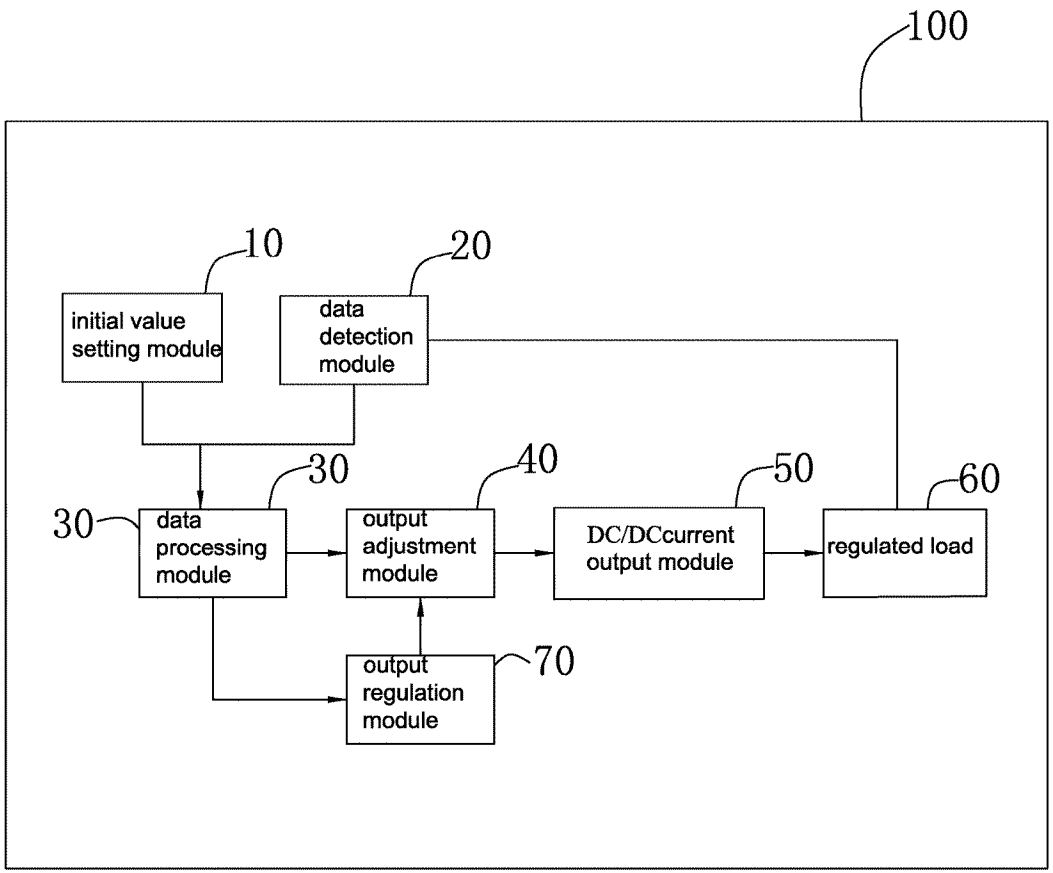
FIG. 1 is a schematic block diagram of a system for regulating the minimum output current of an LED dimming power supply provided by the present invention.
Figure 2:
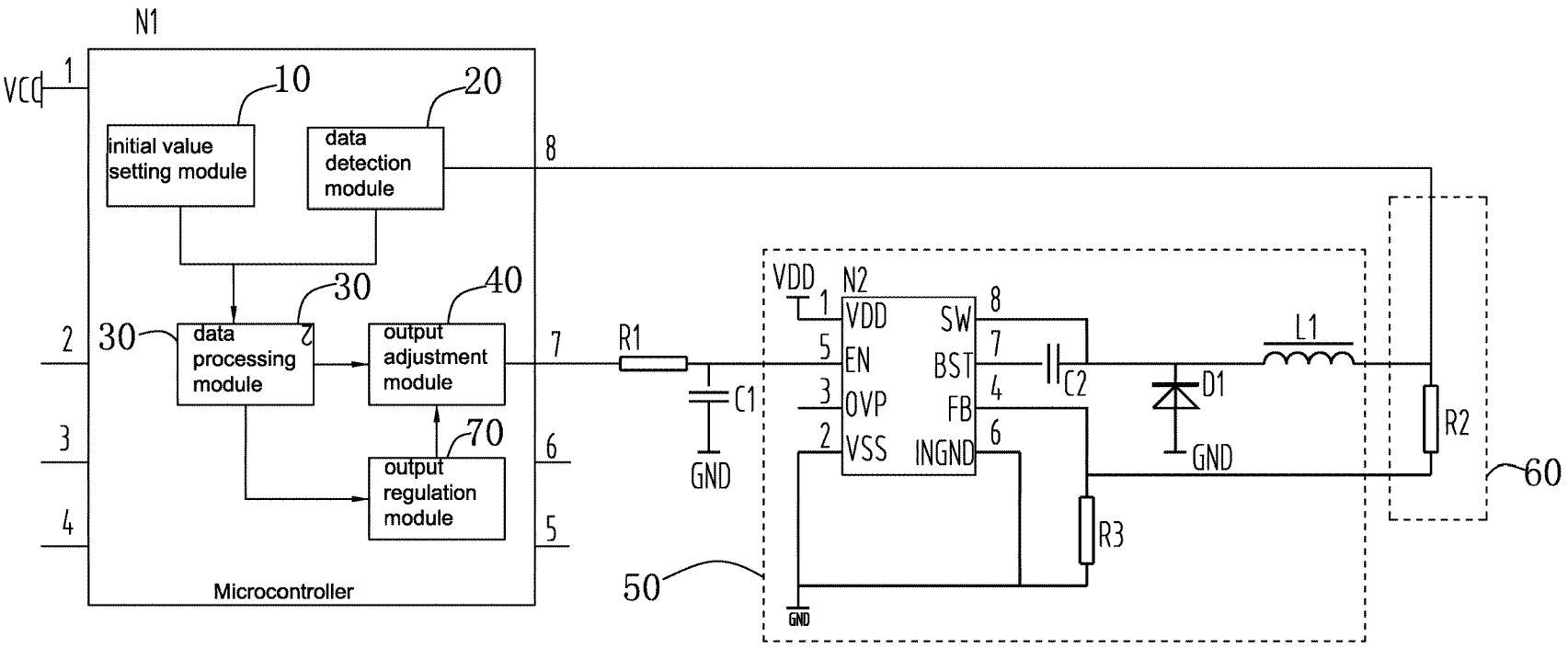
FIG. 2 is an application circuit diagram of the system for regulating the minimum output current of an LED dimming power supply of FIG. 1.

Please referring to FIG. 1 to FIG. 2, which are a schematic block diagram and an application circuit diagram of the system for regulating the minimum output current of an LED dimming power supply provided by the present invention. the system 100 for regulating the minimum output current of an LED dimming power supply comprises an initial value setting module 10, a data detection module 20, a data processing module 30, an output adjustment module 40, a DC/DC current output module 50 electrically connected with the output adjustment module 40, a regulated load 60 connected in series at the output of the DC/DC current output module 50, and an output regulation module 70. The LED dimming power supply is used to adjust the parameters of the connected load such as the brightness or the color temperature of the LED lamp. Therefore, the output current or output voltage of the LED dimming power supply can be controlled by a manual or automatic device.

It can be understood that the system 100 for regulating the minimum output current of the LED dimming power supply may further comprises other functional modules such as a power module for providing a DC constant voltage to the DC/DC current output module 50, and a front-end power supply module providing the compliance power for the initial value setting module 10, the data detection module 20, the data processing module 30. All these above are well-known to those skilled in the art, and they will not be described in detail.

The initial value setting module 10 is configured to preset a threshold value of a minimum output rated current of the LED dimming power supply and tune the control signal output by the output adjustment module 40 that controls the output value of the DC/DC current output module 50 to the minimum. The threshold value can be set according to the user's requirement or set by the provider of the LED dimming power supply in the factory. When the threshold value is set, the threshold value is the minimum output rated current of the LED dimming power supply. Meanwhile, the output current of the LED dimming power supply is a value between the minimum output rated current and the maximum output current. In a light environment, such as the living room, the mall ceilings, the exhibition cabinet, etc., a plurality of LED lamps of the same type are usually powered by a plurality of power sources. If the minimum output rated current is not set, these same type of LED lamps are adjusted to the minimum brightness or other parameters such as color temperature, there will be some brighter, some darker, some higher color temperature, and some lower color temperature, and it will give people poor experience with light. The threshold value determines the minimum value for each parameter of each LED lamp of the same type when the LED lamp works. The setting of the threshold value can be set according to the selection of the specification parameters of various components of the LED dimming power supply. When the components are integrated in an integrated chip such as a microcontroller, the threshold value can be written by a program set, while the principle is the same. In this embodiment, the LED dimming power supply uses a microcontroller to reduce the size and the cost of the power supply. Therefore, the threshold value is programmed into the LED dimming power supply. As for the maximum output current of the LED dimming power supply, the current is not adjusted by the output adjustment module 40. When the output adjustment module 40 includes the PWM signal generator, the duty cycle of the PWM signal output by the PWM signal generator is 1, that is, the output adjustment module 40 does not adjust the output of the LED dimming power supply, At this moment, the output current of the LED dimming power supply is the maximum value. However, since the present invention is used to regulate the minimum output current of the LED dimming power supply, the control signal of the output adjustment module 40 should be the minimum value in the beginning. At the same time, the output value of the DC/DC current output module 50 is the minimum. The initial value setting module 10 is further configured to tune the control signal output by the output adjustment module 40 that controls the output value of the DC/DC current output module 50 to the minimum.

The data detection module 20 is used for detecting the load current flowing on the regulated load 60. The magnitude of the load current flowing on the load is a technique well-known to those skilled in the art and will not be described in detail herein. The data detection module 20 can be designed and formed by electronic components. In the present embodiment, the data detection module 20 is integrated in the integrated circuit that is a microcontroller. One pin of the microcontroller is connected through a wire at one end of the regulated load 60, a load current flowing through the regulated load 60 can be detected. The data detection module 20 is electrically connected to the data processing module 30 to transmit the detected load current to the data processing module 30.

The data processing module 30 is configured to compare the load current with a threshold value and output a comparison result. In this embodiment, the data processing module 30 is also integrated into an integrated chip, that is, the microcontroller. Of course, it can be understood that the data processing module 30 can also be constructed by some electronic components, such as those known by those skilled in the art through transistors, regulator, and operational amplifiers. The data processing module 30 receives the threshold value of the initial value setting module 10 and the load current detected by the data detection module 20 and compares the threshold value with the load current so as to obtain a comparison value.

The output adjustment module 40 is configured to adjust the output control signal according to the output result of the data processing module 30 when the load current is less than the threshold value to adjust the output voltage of the DC/DC current output module 50 to load the current value at the regulated load 60 is equal to the threshold value. The output adjustment module 40 is also an executing module of the dimming command of the LED dimming power supply. That is, when the user needs to adjust the light-emitting parameters of the lamp connected to the LED dimming power supply, the output voltage of the LED dimming power supply is adjusted by the output adjustment module 40. In the present embodiment, the output voltage of the DC/DC current output module 50 is adjusted by adjusting the output of the output adjustment module 40 to adjust the output voltage of the LED dimming power supply. The output adjustment module 40 can be various electronic components that can adjust the output voltage, such as a dip switch, a PWM signal generator, and so on. In this embodiment, the output adjustment module 40 is a PWM signal generator, which is also integrated in the integrated chip, that is, a microcontroller. The magnitude of the input voltage of the DC/DC current output module 50 can be adjusted by adjusting the duty cycle of the PWM signal output by the PWM signal generator, so as to adjust the magnitude of the current flowing on the regulation load 60, to adjust the output of the LED dimming power supply. Of course, it is conceivable that the regulatory load 60 can be replaced by various types of LED lamps in actual use. When the load current detected by the data detection module 20 is less than the threshold value, it is considered that the minimum output current of the LED dimming power supply does not reach the output minimum rated current, and therefore, the output current needs to be adjusted to be equal to the threshold value. In this embodiment, the output current of the DC/DC current output module 50 can be adjusted to the threshold value by adjusting the duty cycle of the PWM signal. Since the output of the output adjustment module 40 is initially the minimum value, the output of the DC/DC current output module 50 should also be the minimum value, so that if the load current detected by the data detection module 20 at this time is greater than the threshold value, it indicates that the LED dimming power supply has failed and is a failed power supply.

The DC/DC current output module 50 may be a switching power supply chip that switch in high frequency through controllable switches (MOSFETs, etc.) utilizing the characteristics of energy storage of the capacitors or inductors and stores the input electrical energy in a capacitor (inductance), when the switch is off, the power is released to the load and provide energy. The ability to output power or voltage of the DC/DC current output module 50 is related to the duty cycle (the ratio of on-time of the switch to the entire period of the switch). The DC/DC current output module 50 can be used to Increase voltage and reduce voltage. In the present embodiment, the DC/DC current output module 50 is a buck conversion circuit, and the voltage value can be adjusted to an arbitrary value.

The regulated load 60 is connected in series at the output of the DC/DC current output module 50, so that the output voltage of the DC/DC current output module 50 is loaded on the regulated load 60. The larger the resistance of the regulated load 60 is, the better the signal-to-noise ratio is. Therefore, in the present embodiment, the resistance of the regulated load 60 is greater than 200 ohms.

The output regulation module 70 is configured to regulate the output value of the control signal of the output adjustment module 40 when the load current is equal to the threshold value by adjusting the control signal of the output adjustment module 40. In this embodiment, the output regulation module 70 is also integrated into an integrated chip, that is, the microcontroller. Of course, it can be understood that the data regulation module 70 can also be constructed by some electronic components, such as those known by those skilled in the art through transistors, regulator, and operational amplifiers. When the load current is equal to the threshold value, it indicates that the minimum output current of the LED dimming power supply is already compliant. Therefore, the control signal of the output adjustment module 40 is fixed and recorded In the microcontroller by the output regulation module 70 for regulation. When the regulated LED dimming power supply is turned on, the output signal value of the output adjustment module 40 will be greater than or equal to the output value regulated by the output regulation module 70, that is, the minimum value of the output current of the LED dimming power supply will be equal to the threshold value.

Compared with the prior art, the system 100 for regulating the minimum output current of the LED dimming power supply provided by the present invention is capable of utilizing the initial value setting module 10, the data detection module 20, the data processing module 30, and the output regulation module 70 to make the regulated load 60 modularization and standardization. It means that the resistance of the regulated load 60 is designed to a standard value, and the regulated load 60 is set in a standard module, when the batches of LED dimming power supply need to regulate the minimum output current. The output of the LED dimming power supply are electrically connected to the standard module provided with the regulated load 60 to complete the setting of the minimum output current of the LED dimming power supply, so as to avoid human error caused by manual calibration and be particularly suitable for the mass production calibration in the factory.

The above disclosure has been described by way of example and in terms of exemplary embodiment, and it is to be understood that the disclosure is not limited thereto. Rather, any modifications, equivalent alternatives or improvement etc. within the spirit of the invention are encompassed within the scope of the invention as set forth in the appended claims.

The invention claimed is:

1. A system for regulating the minimum output current of an LED dimming power supply, comprising:

an initial value setting module, a data detection module, a data processing module, an output adjustment module, a DC/DC current output module electrically connected with the output adjustment module, a regulated load connected in series at the output of the DC/DC current output module, and an output regulation module, the initial value setting module being configured to preset a threshold value of a minimum output rated current of the LED dimming power supply and tune a control signal output by the output adjustment module that controls an output value of the DC/DC current output module to the minimum, the data detection module being configured to detect a load current flowing through the regulated load, the data processing module being configured to compare the load current with the threshold value and output a comparison result, the output adjustment module being configured to adjust the output control signal according to the output result of the data processing module, while the load current is less than the threshold value, in order to adjust the output voltage of the DC/DC current output module, and make sure that the current value on the regulated load is equal to the threshold value, the DC/DC current output module being configured to convert an input DC constant voltage into a DC constant current, and the output regulation module being configured to regulate the output value of the control signal of the output adjustment module when the load current is equal to the threshold value by adjusting the control signal of the output adjustment module.

2. The system for regulating the minimum output current of an LED dimming power supply as claimed in claim 1, wherein the output current value of the DC/DC current output module is greater than or equal to the threshold value.

3. The system for regulating the minimum output current of an LED dimming power supply as claimed in claim 1, wherein the regulated load is a resistor.

4. The system for regulating the minimum output current of an LED dimming power supply as claimed in claim 1, wherein the resistance of the resistor is greater than 200 ohms.

5. The system for regulating the minimum output current of an LED dimming power supply as claimed in claim 1, wherein the initial value setting module, the data detection module and the data processing module are integrated in a microcontroller, and the microcontroller performs its function.

6. The system for regulating the minimum output current of an LED dimming power supply as claimed in claim 1, wherein the output signal of the output adjustment module is a PWM signal.

7. The system for regulating the minimum output current of an LED dimming power supply as claimed in claim 6, wherein the output adjustment module is integrated in a microcontroller, and the microcontroller performs its function.

8. The system for regulating the minimum output current of an LED dimming power supply as claimed in claim 1, wherein the LED dimming power supply comprises the initial value setting module, the data detection module, the data processing module, the output adjustment module, and the DC/DC current output module electrically connected with the output adjustment module.

9. The system for regulating the minimum output current of an LED dimming power supply as claimed in claim 1, wherein when the load current is greater than the threshold value, the LED dimming power supply is a non-qualified product.

* * * * *